US009605330B2

(12) United States Patent
Katsumata et al.

(10) Patent No.: US 9,605,330 B2
(45) Date of Patent: Mar. 28, 2017

(54) VACUUM HEAT TREATMENT DEVICE

(71) Applicants: IHI Corporation, Tokyo (JP); IHI Machinery and Furnace Co., Ltd., Tokyo (JP)

(72) Inventors: Kazuhiko Katsumata, Kakamigahara (JP); Noboru Kiya, Kakamigahara (JP); Noriaki Nagai, Kakamigahara (JP); Noboru Hiramoto, Kakamigahara (JP)

(73) Assignees: IHI CORPORATION (JP); IHI MACHINERY AND FURNANCE CO., LTD. (JP)

( * ) Notice: Subject to any disclaimer, the term of this patent is extended or adjusted under 35 U.S.C. 154(b) by 175 days.

(21) Appl. No.: 14/305,138

(22) Filed: Jun. 16, 2014

(65) Prior Publication Data

US 2014/0291903 A1 Oct. 2, 2014

Related U.S. Application Data

(63) Continuation of application No. PCT/JP2012/082360, filed on Dec. 13, 2012.

(30) Foreign Application Priority Data

Dec. 28, 2011 (JP) ..... 2011-288539

(51) Int. Cl.
*C21D 9/00* (2006.01)
*C21D 1/773* (2006.01)
(Continued)

(52) U.S. Cl.
CPC ..... *C21D 9/0062* (2013.01); *C21D 1/773* (2013.01); *F27B 5/04* (2013.01); *F27B 5/06* (2013.01); *F27D 2009/0005* (2013.01)

(58) Field of Classification Search
CPC ..... C21D 1/773; C21D 9/0062; F27B 5/04; F27B 5/06; F27D 2009/0005
(Continued)

(56) References Cited

U.S. PATENT DOCUMENTS 4,610,435 A * 9/1986 Pfau ..... C21D 1/767 266/250
6,821,114 B2 * 11/2004 Kisoda ..... C21D 1/767 432/176
2007/0122761 A1 5/2007 Katsumata ..... 432/77

FOREIGN PATENT DOCUMENTS

CN 1813163 A 8/2006
JP 60-135517 7/1985
(Continued)

OTHER PUBLICATIONS

International Search Report and Written Opinion mailed Jan. 29, 2013 in corresponding PCT International Application No. PCT/JP2012/082360.
(Continued)

*Primary Examiner* — Scott Kastler
*Assistant Examiner* — Michael Aboagye
(74) *Attorney, Agent, or Firm* — Ostrolenk Faber LLP

(57) ABSTRACT

The vacuum heat treatment device includes: a guide plate used to guide a cooling medium supplied by a cooling unit, into a heat-insulating container through one of at least two openings of the heat-insulating container in a state where the two openings of the heat-insulating container are opened; and a movement mechanism used to move the guide plate so that at least part of the guide plate is inserted into a movement area of a cover portion in a state where the two openings of the heat-insulating container are opened and so that the guide plate is retracted from the movement area of
(Continued)

the cover portion before the cover portion is moved in order to close the two openings of the heat-insulating container.

8 Claims, 9 Drawing Sheets

(51) Int. Cl.
*F27B 5/04* (2006.01)
*F27B 5/06* (2006.01)
*F27D 9/00* (2006.01)

(58) Field of Classification Search
USPC ..... 266/249–264; 432/200, 201, 202, 203, 432/204, 205
See application file for complete search history.

(56) References Cited

FOREIGN PATENT DOCUMENTS

| | | |
|---|---|---|
| JP | 05-230528 | 9/1993 |
| JP | 06-100928 | 4/1994 |
| JP | 2004-084997 | 3/2004 |
| WO | WO 2011/136032 A1 | 11/2011 |

OTHER PUBLICATIONS

Chinese Office Action, dated Apr. 16, 2015, issued in corresponding Chinese Patent Application No. 201280064299.6. Partial Translation of Search Report. Total 7 pages.

* cited by examiner

VACUUM HEAT TREATMENT DEVICE

This application is a Continuation application based on International Application No. PCT/JP2012/082360, filed Dec. 13, 2012, which claims priority on Japanese Patent Application No. 2011-288539, filed Dec. 28, 2011, the contents of which are incorporated herein by reference.

TECHNICAL FIELD

The present invention relates to a vacuum heat treatment device which heats a treatment object in a vacuum.

BACKGROUND ART

In order to increase the hardness of steel, so-called quenching treatment in which steel is heated up to a predetermined temperature and thereafter is cooled is generally performed. Specifically, first, steel is heated up to a temperature between 911° C. and 1392° C. under 1 atmospheric pressure, and thereby the phase of the steel is changed into austenite. Subsequently, the steel of austenite is quenched, and the phase thereof is changed into martensite. In this way, the hardness of steel is increased.

When heat treatment such as quenching is performed, a vacuum heat treatment device is used. The vacuum heat treatment device has a double structure including a vacuum furnace and a heat-insulating container which is provided inside the vacuum furnace, wherein a treatment object is disposed inside the heat-insulating container. When the heat treatment using the vacuum heat treatment device is performed, first, the vacuum furnace and the heat-insulating container are opened and a treatment object is disposed inside the heat-insulating container, and subsequently, the vacuum furnace is closed and the inside thereof is made into a vacuum state. When the inside reaches the vacuum state, the heat-insulating container is closed and the treatment object is heated. After a predetermined period has passed, the heat-insulating container is opened, a cooling medium is supplied into the vacuum furnace and into the heat-insulating container, and the treatment object disposed in the heat-insulating container is cooled.

In a case where a treatment object is cooled at the vacuum heat treatment device as described above, a cooling medium is supplied into the heat-insulating container. At this time, if the cooling medium does not reach every part inside the heat-insulating container, the cooling to the treatment object may not be uniformly performed. For example, when the heat treatment of steel as a treatment object is performed, the unevenness in quenching may occur, and the hardness of steel may become non-uniform. In addition, when the heat treatment of stainless steel as a treatment object is performed, sensitization may occur.

In order to cool a treatment object, a vacuum heat treatment device is disclosed in which nitrogen gas is supplied into a vacuum furnace, a fan circulates the nitrogen gas in a heat-insulating container, and the nitrogen gas discharged from the heat-insulating container is cooled and is supplied into the heat-insulating container again (e.g., refer to Patent Document 1). In the vacuum heat treatment device disclosed in Patent Document 1, in order to efficiently guide nitrogen gas into the heat-insulating container, wind direction guide vanes are fixed to an inner wall of the vacuum furnace.

DOCUMENT OF RELATED ART

Patent Document

[Patent Document 1] Japanese Patent Application, First Publication No. H5-230528

SUMMARY OF INVENTION

Technical Problem

In the heat-insulating container disclosed in Patent Document 1, openings used to circulate nitrogen gas are formed in the vertically upper and lower surfaces thereof, and slide doors which open and close the openings by sliding with respect to the openings are provided. If the positions of the wind direction guide vanes are closer to the openings of the heat-insulating container, nitrogen gas can be more uniformly guided in order to reach every part inside the heat-insulating container. However, if the wind direction guide vanes are merely brought close to the openings of the heat-insulating container, the wind direction guide vanes may contact the slide doors when the slide doors are moved. Accordingly, it is necessary to fix the wind direction guide vanes to positions separated from the openings of the heat-insulating container, such as positions different from the movement areas of the slide doors. As a result, in the technology of Patent Document 1, it may be difficult to guide nitrogen gas so as to reach every part of the inside of the heat-insulating container.

In addition, spaces in which the wind direction guide vanes are provided are required in addition to the movement areas of the slide doors, and thus, the vacuum heat treatment device may be increased in size.

The present invention aims, in view of the above circumferences, to provide a vacuum heat treatment device capable of supplying a cooling medium to reach every part inside a heat-insulating container using a simple structure, and of decreasing the size of the vacuum heat treatment device by efficiently using the space inside a vacuum furnace.

Solution to Problem

According to a first aspect of the present invention, a vacuum heat treatment device includes: a vacuum furnace capable of decompressing an inside thereof to a vacuum state; a heat-insulating container provided inside the vacuum furnace, the heat-insulating container being used to accommodate a treatment object and being provided with at least two openings; a heating portion provided in the heat-insulating container, the heating portion being used to heat the treatment object; a cover portion used to close at least the two openings of the heat-insulating container during heating to the treatment object by the heating portion; and a cooling unit used to cool and supply a cooling medium, the cooling unit being used to gather the supplied cooling medium. In addition, the vacuum heat treatment device further includes: a guide plate used to guide the cooling medium supplied by the cooling unit, into the heat-insulating container through one of the two openings of the heat-insulating container in a state where the two openings of the heat-insulating container are opened; and a movement mechanism used to move the guide plate so that at least part of the guide plate is inserted into a movement area of the cover portion in a state where the two openings of the heat-insulating container are opened and so that the guide plate is retracted from the movement area of the cover portion before the cover portion is moved in order to close the two openings of the heat-insulating container.

According to a second aspect of the present invention, in the vacuum heat treatment device of the first aspect, the movement mechanism rotates the guide plate in order to insert the guide plate into the movement area or in order to retract the guide plate from the movement area.

According to a third aspect of the present invention, in the vacuum heat treatment device of the first or second aspect, the guide plate includes: a first guide portion capable of being inserted into the movement area of the cover portion, the first guide portion allowing the cooling medium which flows in a direction parallel to a surface of the heat-insulating container provided with the one of the two openings to strike on the first guide portion so as to guide the cooling medium into the heat-insulating container; and a second guide portion used to guide the cooling medium to the first guide portion.

According to a fourth aspect of the present invention, the vacuum heat treatment device of any one of the first to third aspects further includes: a regulating plate provided further upstream than the one of the two openings in a flow direction of the cooling medium supplied from the cooling unit, the regulating plate being used to block the cooling medium directly flowing toward the one of the two openings in a direction parallel to a surface of the heat-insulating container provided with the one of the two openings.

According to a fifth aspect of the present invention, in the vacuum heat treatment device of the fourth aspect, the regulating plate includes a projecting portion provided in a central portion of a surface of the regulating plate facing upstream in a flow direction of the cooling medium. In addition, the regulating plate is formed so that a cross-sectional area of the regulating plate in a direction orthogonal to the flow direction of the cooling medium gradually increases as it approaches downstream in the flow direction of the cooling medium.

Effects of Invention

According to the present invention, it is possible to supply a cooling medium so as to reach every part inside a heat-insulating container using a simple structure, and to decrease the size of a vacuum heat treatment device by efficiently using the space inside a vacuum furnace.

DESCRIPTION OF EMBODIMENTS

Hereinafter, preferable embodiments of the present invention are described in detail with reference to the drawings. A dimension, a material, a specific numerical value or the like shown in the embodiments is merely an example in order to facilitate an understanding of the present invention, and it does not limit the present invention unless there is a special description. Moreover, in the specification and the drawings, components having substantially the same function and structure are represented by the same reference signs and thus description thereof may be omitted, and illustrations of components not directly relating to the present invention may be omitted.

First Embodiment

Figure 1:
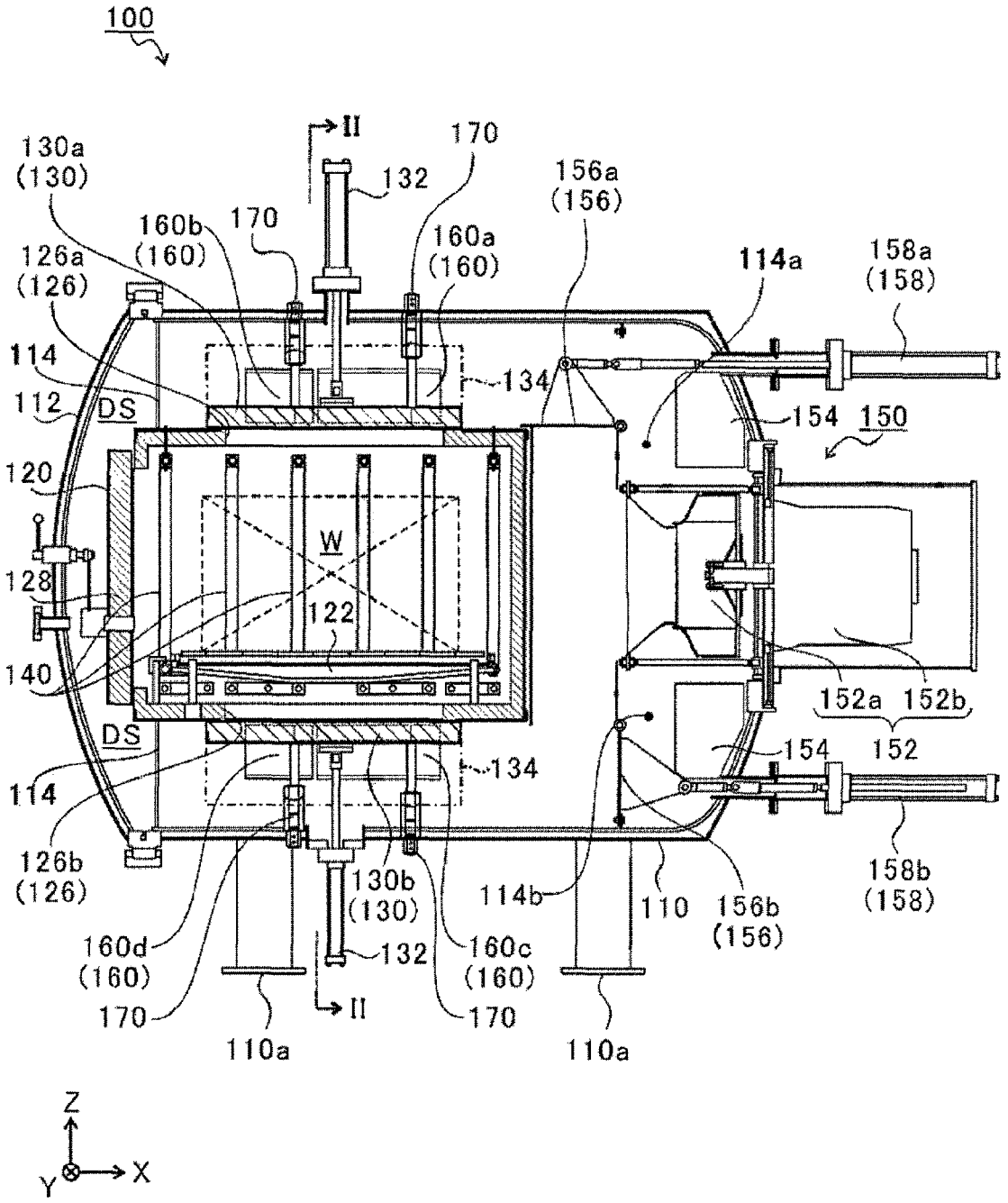
FIG. 1 is a lateral cross-sectional view showing a vacuum heat treatment device according to a first embodiment of the present invention.
Figure 2:
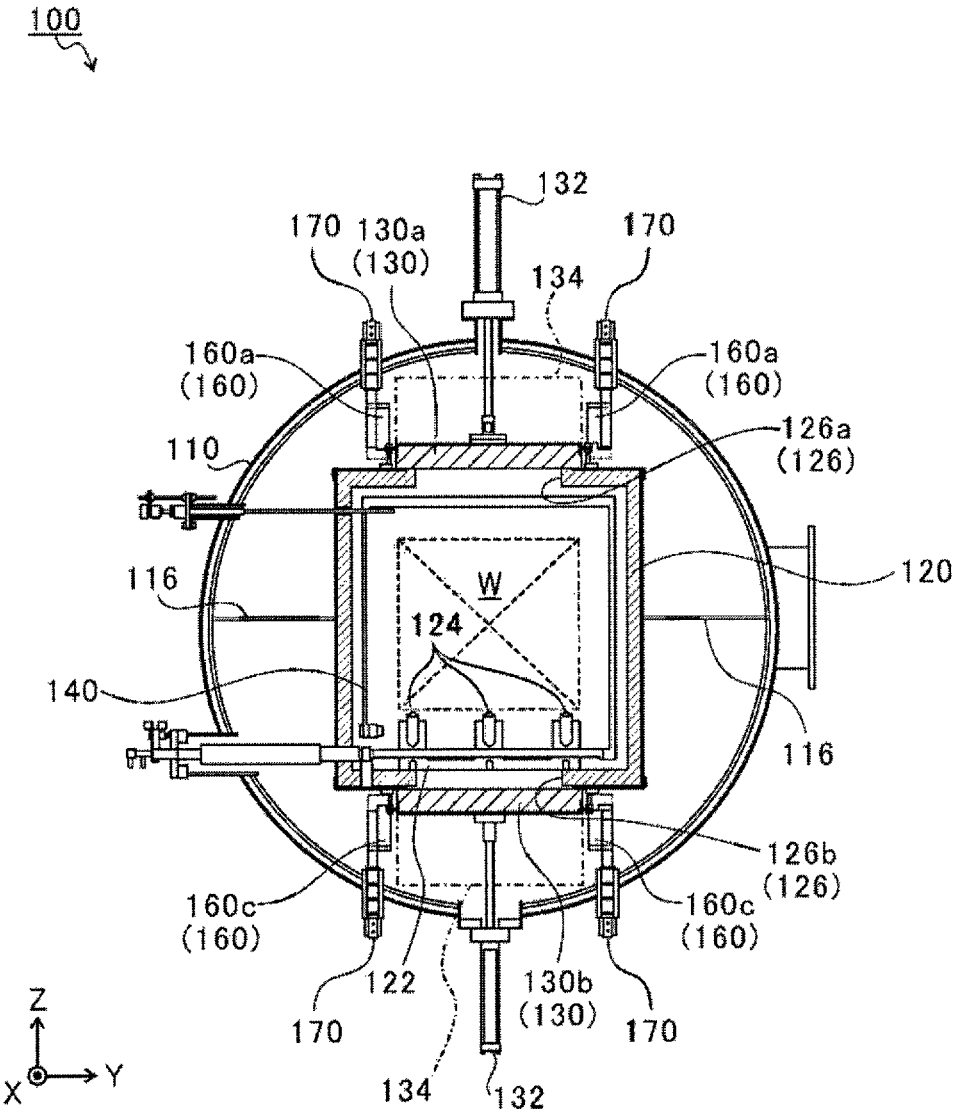
FIG. 2 is a cross-sectional view along a II-II line of FIG. 1.

FIG. 1 is a lateral cross-sectional view showing a vacuum heat treatment device 100 according to a first embodiment. FIG. 2 is a cross-sectional view along a II-II line of FIG. 1.

As shown in FIGS. 1 and 2, the vacuum heat treatment device 100 is a single chamber vacuum heat treatment device which performs a heating process and a cooling process on a treatment object W in a single chamber. The vacuum heat treatment device 100 includes a vacuum furnace 110, a heat-insulating container 120, cover portions 130, a heating portion 140, a cooling unit 150, guide plates 160, and movement mechanisms 170.

The vacuum furnace 110 is formed in an approximately cylindrical shape in order to hold a pressure even when the pressure state inside the vacuum furnace 110 is changed. The vacuum furnace 110 of this embodiment is fixed and supported by posts 110*a* so that the central axis of the cylinder thereof extends in the horizontal direction (in the X-axis direction in FIGS. 1 and 2). In addition, the vacuum furnace 110 is provided with a door 112, and when the door 112 is closed, the vacuum furnace 110 has an enclosed space therein. Furthermore, a vacuum pump (not shown) is connected to the vacuum furnace 110, and in a state where the door 112 is closed, the vacuum pump decompresses the inside of the vacuum furnace 110 to a vacuum state.

In addition, an inert gas-supplying unit (not shown) is connected to the vacuum furnace 110, and the inert gas-supplying unit supplies inert gas into the vacuum furnace 110 in order to prevent the oxidation or coloration of a treatment object W. The inert gas supplied by the inert gas-supplying unit is utilized as a cooling medium used to cool the treatment object W. Specifically, the inert gas-supplying unit includes a pumping device which pumps inert gas into the vacuum furnace 110, and a measuring device which measures a pressure inside the vacuum furnace 110. The inert gas includes, for example, nitrogen gas ($N_2$), argon gas (Ar), helium gas (He) or the like, or a mixture thereof.

Furthermore, the vacuum furnace 110 is provided with baffle plates 114 and 116 which partition the space inside the vacuum furnace 110 into several spaces. The baffle plate 114 is a plate which is provided on a Y-Z plane in FIG. 1 and which blocks a space between the inner circumferential surface of the vacuum furnace 110 and the outer circumferential surface of the heat-insulating container 120. By providing the baffle plate 114, the cooling medium supplied by the cooling unit 150 (described later) is prevented from flowing into a space DS formed between the heat-insulating container 120 and the door 112, and from being gathered by the cooling unit 150 without being supplied into the heat-insulating container 120 (without cooling the treatment object W). The baffle plates 116 are plates which are provided on an X-Y plane in FIG. 2 and which block spaces between the inner circumferential surface of the vacuum furnace 110 and the outer circumferential surface of the heat-insulating container 120. By providing the baffle plates 116, the cooling medium supplied by the cooling unit 150 is prevented from flowing by the sides of the heat-insulating container 120 and from being gathered by the cooling unit 150 without being supplied into the heat-insulating container 120.

The heat-insulating container 120 is a container which accommodates the treatment object W, and is provided inside the vacuum furnace 110 and is composed of a heat-insulating material using wool such as graphite wool or ceramic wool. In the heat-insulating container 120, the heating process and the cooling process are performed on the treatment object W. In addition, as shown in FIG. 2, a mounting table 122 on which the treatment object W is mounted is provided inside the heat-insulating container 120, and ceramic rods 124 which prevent the fusion of the treatment object W to the mounting table 122 are disposed on the mounting table 122. Moreover, the mounting table 122 has a structure through which gas (a cooling medium) can pass (e.g., a grating structure) in the vertical direction (in the Z-axis direction in FIGS. 1 and 2).

In addition, the heat-insulating container 120 includes openings 126 (represented by reference signs 126*a* and 126*b* in FIGS. 1 and 2) which are provided on two surfaces opposite to each other of the heat-insulating container 120 (in this embodiment, the two surfaces being opposite to each other in the vertical direction (in the Z-axis direction in FIGS. 1 and 2), that is, the top and bottom surfaces). That is, two openings 126 are provided in the heat-insulating container 120 of this embodiment, an opening 126*a* is formed on the top surface of the heat-insulating container 120, and an opening 126*b* is formed on the bottom surface of the heat-insulating container 120. Although described later in detail, a cooling medium is supplied into the heat-insulating container 120 through the opening 126, and thereby, the cooling process is performed to the treatment object W accommodated in the heat-insulating container 120.

Furthermore, as shown in FIG. 1, the heat-insulating container 120 is provided with an attachable and detachable side wall 128. The side wall 128 is connected to the door 112 of the vacuum furnace 110, and by opening the door 112, the side wall 128 together with the door 112 is detached from the main body of the heat-insulating container 120. By opening the side wall 128, it is possible to load the treatment object W into the heat-insulating container 120 and to unload the treatment object W from the inside of the heat-insulating container 120.

The cover portions 130 (represented by reference signs 130*a* and 130*b* in FIGS. 1 and 2) are provided in the upper and lower sides of the heat-insulating container 120. A cover portion 130*a* is disposed over the heat-insulating container 120, and a cover portion 130*b* is disposed under the heat-insulating container 120. The cover portions 130 can move in the vertical direction by cylinder mechanisms 132 and are configured to open and close the openings 126 provided in the heat-insulating container 120.

The heating portion 140 is a lattice-shaped component configured to surround the treatment object W and is provided inside the heat-insulating container 120. The heating portion 140 heats the inside of the heat-insulating container 120 to, for example, 1000° C. or more when the cover portions 130 close the openings 126, and thereby, performs the heating process to the treatment object W.

The cooling unit 150 has a function of cooling the cooling medium supplied into the vacuum furnace 110 by the inert gas-supplying unit, and functions of supplying and gathering the cooling medium. The cooling medium includes, for example, nitrogen gas, argon gas, helium gas or the like, or a mixture thereof. Specifically, as shown in FIG. 1, the cooling unit 150 of this embodiment includes a blower 152, heat exchangers 154, and switching plates 156.

The blower 152 includes a fan 152*a* which circulates the cooling medium in the vacuum furnace 110, and a fan motor 152*b* which drives the fan 152*a*. In the blower 152, the fan 152*a* rotates around a rotation axis parallel to the X-axis in FIG. 1. The heat exchangers 154 are composed of a plurality of fin tubes and are provided over and under the fan 152*a* in the vertical direction. The cooling medium passes among the plurality of fin tubes composing the heat exchangers 154, and thus, the cooling medium which has been heated in accordance with the cooling to the treatment object W is cooled again.

The switching plates 156 (represented by reference signs 156*a* and 156*b* in FIG. 1) are moved by cylinder mechanisms 158 (represented by reference signs 158*a* and 158*b* in FIG. 1) and change the circulation direction of the cooling medium. In this embodiment, a pair of switching plates 156 are provided, a switching plate 156*a* is disposed above the fan 152*a*, and a switching plate 156*b* is disposed below the fan 152*a*. For example, as shown in FIG. 1, when the cylinder rod of a cylinder mechanism 158*a* extends, the rotated switching plate 156*a* opens a passageway 114*a*, and when the cylinder rod of a cylinder mechanism 158*b* retracts, the rotated switching plate 156*b* closes a passageway 114*b*. In this case, the cooling medium supplied from the blower 152 is cooled by the heat exchanger 154, and thereafter, is guided through the passageway 114*a* to a vertically upper area of the heat-insulating container 120. Subsequently, the cooling medium guided to the vertically upper area of the heat-insulating container 120 is guided into the heat-insulating container 120 by the guide plates 160 (described later). The cooling medium which has been heated by cooling the treatment object W inside the heat-insulating container 120 is discharged from the heat-insulating container 120 through the opening 126*b* and is guided to the blower 152 again. That is, the opening 126*a* becomes an inlet of the cooling medium into the heat-insulating container 120 (one of two openings), and the opening 126*b* becomes an outlet. Hereinafter, the flow of a cooling medium in a state where the opening 126*a* becomes an inlet and the opening 126*b* becomes an outlet is referred to as a "first circulation direction".

On the other hand, when the cylinder rod of the cylinder mechanism 158*a* retracts, the rotated switching plate 156*a* closes the passageway 114*a*, and when the cylinder rod of the cylinder mechanism 158*b* extends, the rotated switching plate 156*b* opens the passageway 114*b*. In this case, the cooling medium supplied from the blower 152 is cooled by the heat exchanger 154, and thereafter, is guided to a vertically lower area of the heat-insulating container 120 through the passageway 114*b*. Subsequently, the cooling medium guided to the vertically lower area of the heat-insulating container 120 is guided into the heat-insulating container 120 by the guide plates 160. The cooling medium which has been heated by cooling the treatment object W inside the heat-insulating container 120 is discharged from the heat-insulating container 120 through the opening 126*a* and is guided to the blower 152 again. That is, the opening 126*b* becomes an inlet of the cooling medium into the heat-insulating container 120 (one of two openings), and the opening 126*a* becomes an outlet. Hereinafter, the flow of a cooling medium in a state where the opening 126*b* becomes an inlet and the opening 126*a* becomes an outlet is referred to as a "second circulation direction".

In this way, in the cooling unit 150, when the cover portions 130 open the openings 126, the cooling medium in the vacuum furnace 110 is circulated by driving the blower 152 and the heat exchangers 154, and thereby, the cooling process is performed to the treatment object W.

The guide plates 160 (represented by reference signs 160*a* to 160*d* in FIG. 1) have a function of guiding the cooling medium supplied by the cooling unit 150, into the heat-insulating container 120 in a state where the openings 126*a* and 126*b* of the heat-insulating container 120 are opened. In this embodiment, eight guide plates 160 in total are provided, a pair of guide plates 160*a* and a pair of guide plates 160*b* (four in total) are disposed over the heat-insulating container 120, and a pair of guide plates 160*c* and a pair of guide plates 160*d* (four in total) are disposed under the heat-insulating container 120. The guide plates 160*a* and 160*b* are provided further upstream than the opening 126*a* in the first circulation direction, and the guide plates 160*c* and 160*d* are provided further upstream than the opening 126*b* in the second circulation direction. The guiding operation of the cooling medium into the heat-insulating container 120 by the guide plates 160 is described in detail later.

The pair of guide plates 160*a* is provided further upstream than the pair of guide plates 160*b* in the first circulation direction. The guide plate 160*a* is formed to be larger than the guide plate 160*b*. The pair of guide plates 160*c* is provided further upstream than the pair of guide plates 160*d* in the second circulation direction. The guide plate 160*c* is formed to be larger than the guide plate 160*d*.

The movement mechanisms 170 move the guide plates 160 so that at least part of the guide plates 160 is inserted into movement areas 134 corresponding to the trajectories of movement of the cover portions 130 in the vertical direction, in a state where the openings 126 are opened, and so that the guide plates 160 are retracted from the movement areas 134 of the cover portions 130 before the cover portions 130 are moved in order to close the openings 126 of the heat-insulating container 120. Moreover, the movement mechanisms 170 may be manually moved by a user or may be composed of actuators such as motors or solenoids. The moving operation of the guide plates 160 by the movement mechanisms 170 is described in detail later.

Next, treatment of a treatment object W using the vacuum heat treatment device 100 of this embodiment is described.

(Loading Process)

First, the door 112 of the vacuum furnace 110, the side wall 128 of the heat-insulating container 120, and the openings 126 are opened, and a treatment object W is loaded into the heat-insulating container 120. Thereafter, the door 112 of the vacuum furnace 110 and the side wall 128 of the heat-insulating container 120 are closed.

(Decompression Process and Inert Gas-Filling Process)

Subsequently, the inside of the vacuum furnace 110 is decompressed to a vacuum state by the vacuum pump (not shown). Moreover, since the openings 126 of the heat-insulating container 120 are opened, the inside of the heat-insulating container 120 enters a vacuum state. Thereafter, inert gas is supplied into the vacuum furnace 110 by the inert gas-supplying unit (not shown) so that the inside of the vacuum furnace 110 has a predetermined pressure.

Figure 3:
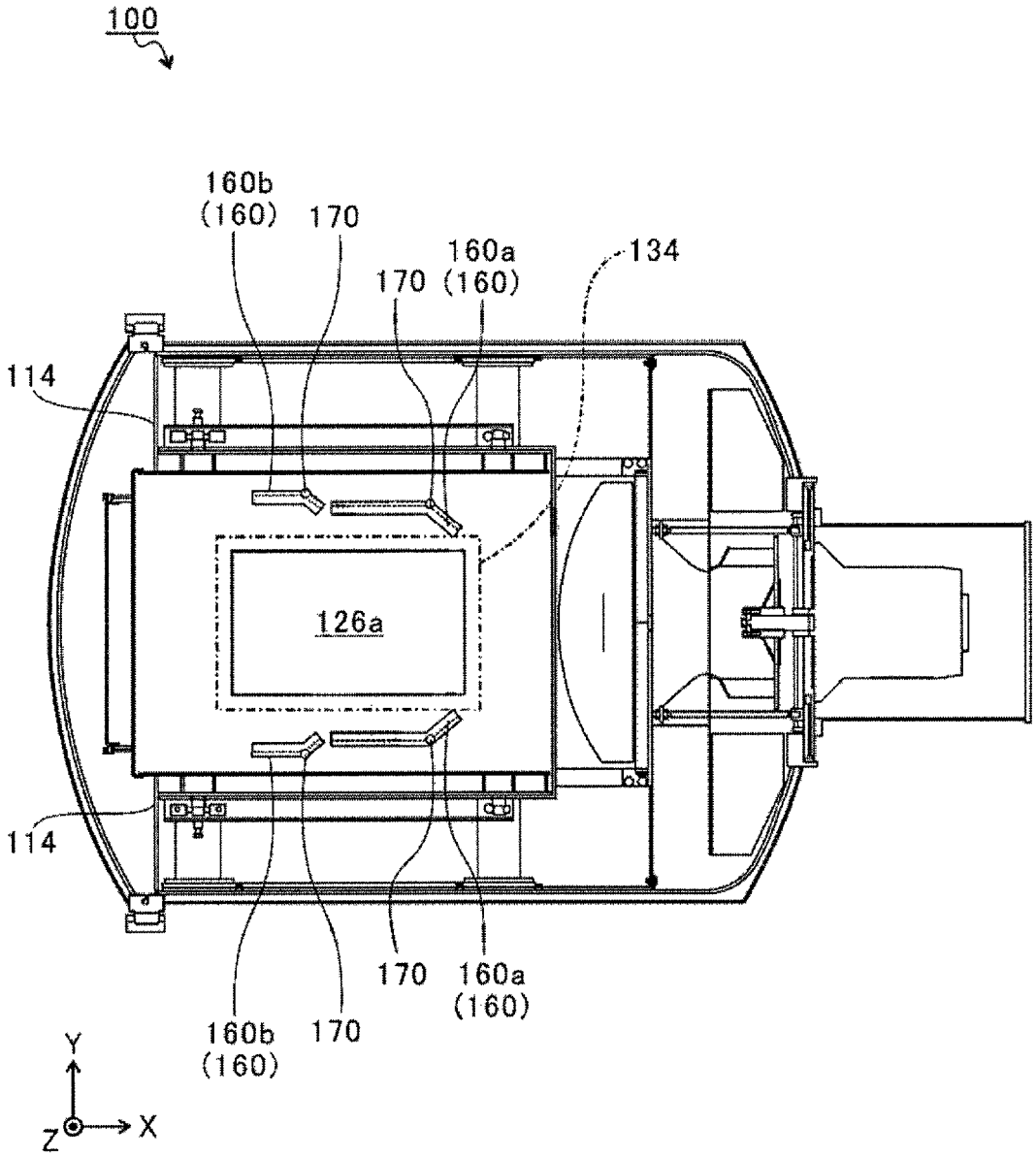
FIG. 3 is a plan cross-sectional view of the vacuum heat treatment device during performance of a loading process, a decompression process, and an inert gas-filling process.

FIG. 3 is a plan cross-sectional view of the vacuum heat treatment device 100 during performance of the loading process, the decompression process, and the inert gas-filling process. Moreover, for convenience of description, the top surface of the vacuum furnace 110 and the cover portion 130*a* are omitted from FIG. 3. As shown in FIG. 3, during performance of the loading process, the decompression process, and the inert gas-filling process, the movement mechanisms 170 retract the guide plates 160*a* and 160*b* from the movement area 134 of the cover portion 130*a* and retract the guide plates 160*c* and 160*d* from the movement area 134 of the cover portion 130*b*. In this way, the guide plates 160 are retracted from the movement areas 134 of the cover portions 130 before the movement of the cover portions 130 in accordance with the heating process (described later) or before the movement of the cover portions 130 in accordance with the cooling process (described later), and thereby, it is possible to prevent the collision between the cover portions 130 and the guide plates 160 when the cover portions 130 are moved.

(Heating Process)

When the inside of the vacuum furnace 110 is filled with the inert gas, the cylinder mechanisms 132 move the cover portion 130*a* vertically downward in order to close the opening 126*a* and move the cover portion 130*b* vertically upward in order to close the opening 126*b*. Thereafter, the heating portion 140 heats the treatment object W for a predetermined time period at a predetermined temperature. In this way, the heating process is performed on the treatment object W.

(Cooling Process)

Figure 4:
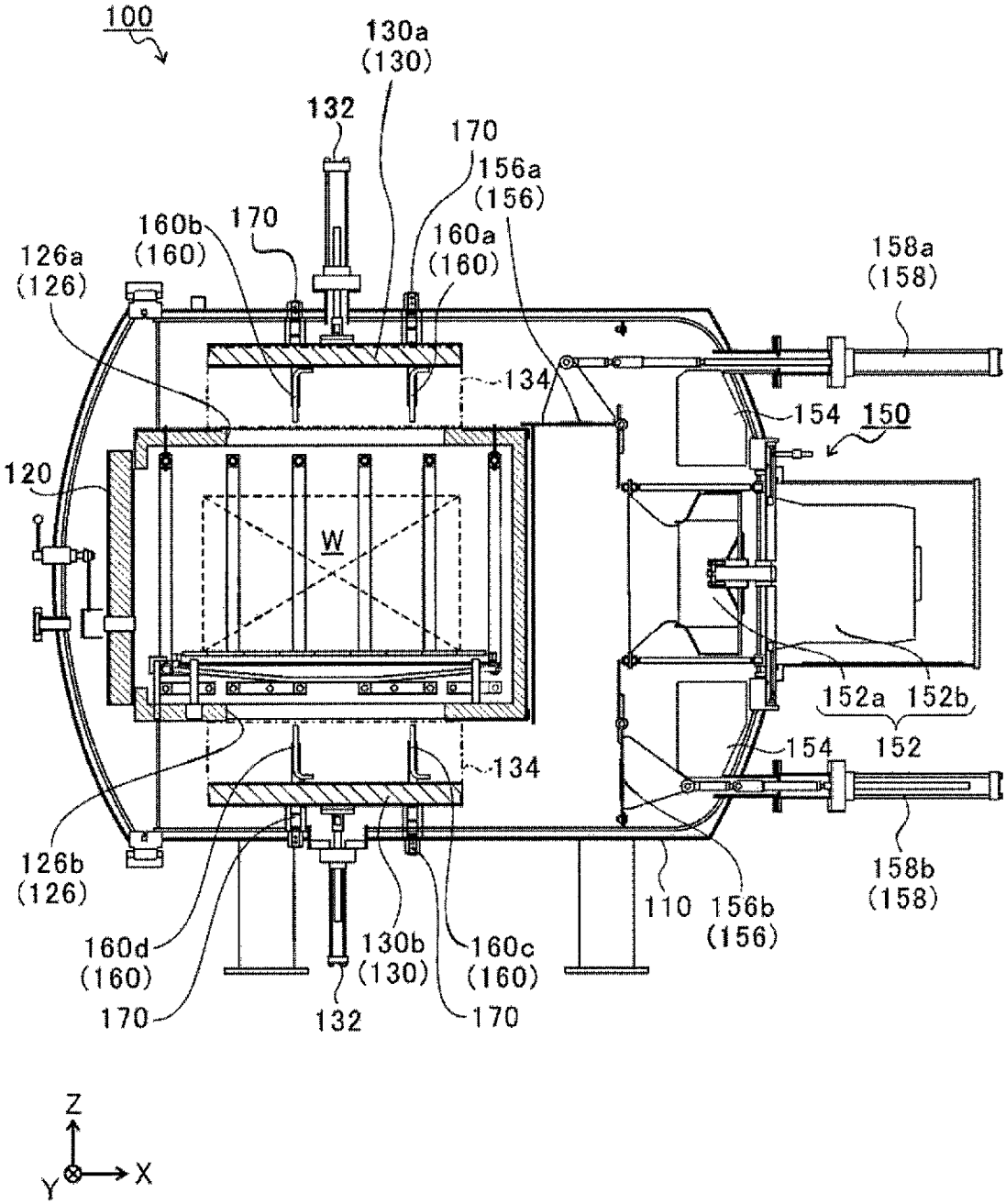
FIG. 4 is a lateral cross-sectional view showing the vacuum heat treatment device during performance of a cooling process.
Figure 5:
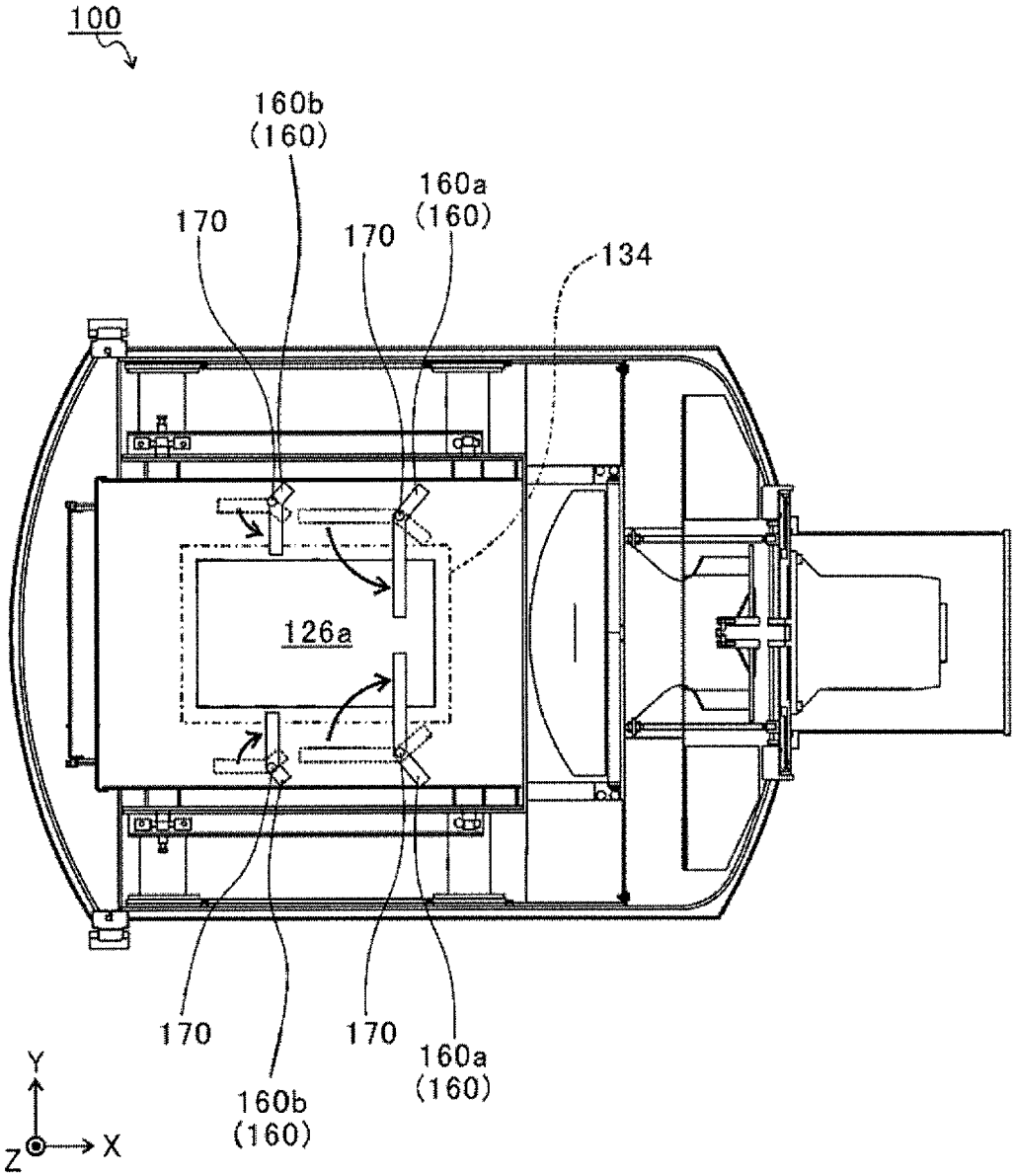
FIG. 5 is a plan cross-sectional view of the vacuum heat treatment device during performance of the cooling process.

FIG. 4 is a lateral cross-sectional view showing the vacuum heat treatment device 100 during performance of the cooling process. FIG. 5 is a plan cross-sectional view of the vacuum heat treatment device 100 during performance of the cooling process. Moreover, for convenience of description, the top surface of the vacuum furnace 110 and the cover portion 130*a* are omitted from FIG. 5.

When the heating process is finished, as shown in FIG. 4, first, the cylinder mechanisms 132 move the cover portion 130*a* vertically upward in order to open the opening 126*a* and move the cover portion 130*b* vertically downward in order to open the opening 126*b*. That is, when the movement of the cover portions 130 is finished, the cover portions 130 are positioned in the outside of the movement areas 134. Thereafter, as shown by arrows in FIG. 5, the movement mechanisms 170 rotate the guide plates 160 around rotation axes extending in the vertical direction (in the Z-axis direction in FIG. 5) in order to insert the guide plates 160 (first guide portions 162*a* and 162*b* described later) into the movement areas 134. In this way, the guide plates 160 are positioned over the opening 126*a* and under the opening 126*b*. Subsequently, the cooling unit 150 starts supplying a cooling medium.

Moreover, as shown in FIG. 5, the length of the guide plate 160*a* is greater than that of the guide plate 160*b*, and the insertion length of the guide plate 160*a* into the movement area 134 is set to be greater than that of the guide plate 160*b*. In addition, the guide plates 160*c* and 160*d* of this embodiment have the same configurations as that of the guide plates 160*a* and 160*b* described above. Unlike this embodiment, the insertion length of the guide plate 160*a* may be set to be less than that of the guide plate 160*b*.

Figure 6:
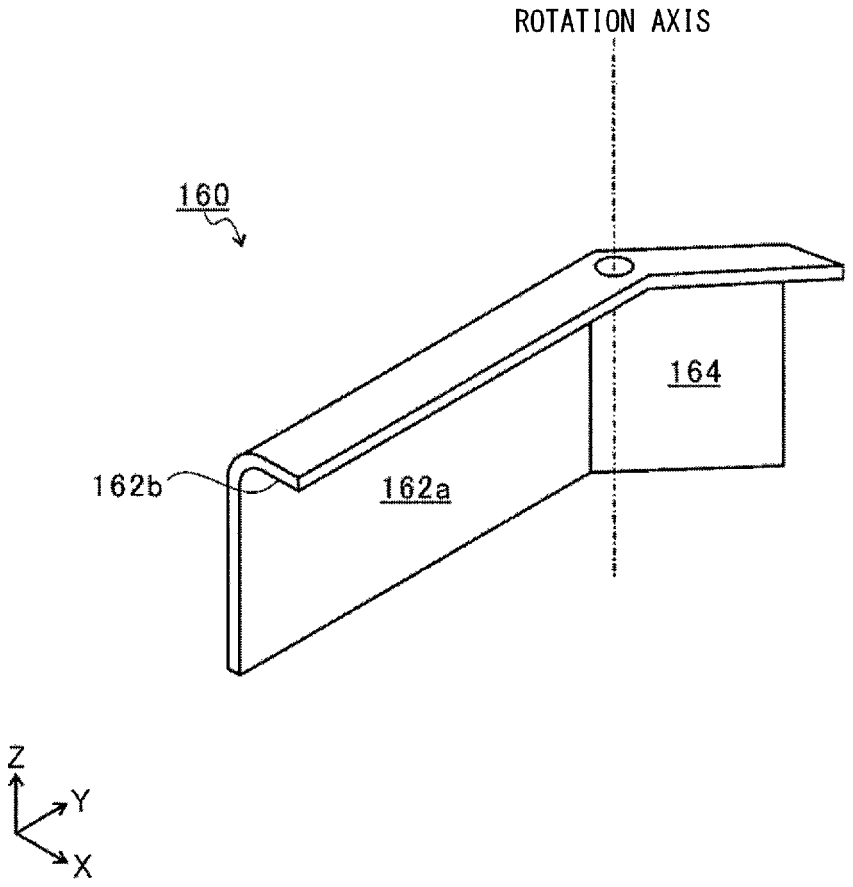
FIG. 6 is a perspective view showing the shape of a guide plate.

FIG. 6 is a perspective view showing the shape of the guide plate 160. As shown in FIG. 6, the guide plate 160 includes first guide portions 162*a* and 162*b*, and a second guide portion 164. In a state where the opening 126 is opened, the first guide portion 162*a* allows the cooling medium which flows in a direction parallel to the surface of the heat-insulating container 120 provided with the opening 126 (in a direction parallel to a X-Y plane in FIG. 6) to strike on the first guide portion 162*a* in order to guide the cooling medium into the heat-insulating container 120. The first guide portion 162*b* allows the cooling medium which strikes on the first guide portion 162*a* and which flows in a direction going away from the opening 126 (vertically upward or downward) to strike on the first guide portion 162*b* in order to guide the cooling medium into the heat-insulating container 120. The second guide portion 164 allows the cooling medium which flows toward the outside of the opening 126 to strike on the second guide portion 164 in order to guide the cooling medium to the first guide portion 162*a*.

Moreover, the first guide portions 162*a* and 162*b* are configured to be inserted into the movement area 134 by the operation of the movement mechanism 170. The first guide portion 162*a* may be formed to have a predetermined inclination so that the struck cooling medium thereon easily flows into the heat-insulating container 120. The first guide portion 162*b* may not be provided in a case where the flow in a direction going away from the opening 126 of the cooling medium which has struck on the first guide portion 162*a* can be ignored.

When the first guide portions 162*a* and 162*b* are inserted into the movement area 134 by the operation of the movement mechanism 170, the second guide portion 164 is disposed in the outside of the movement area 134 (refer to FIG. 5). That is, the second guide portion 164 is configured not to be inserted into the movement area 134 even when the movement mechanism 170 operates and is configured to allow the cooling medium which flows in the outside of the movement area 134 to strike on the second guide portion 164 in order to guide the cooling medium to the first guide portion 162*a*. The first guide portion 162*a* and the second guide portion 164 are connected together so that an acute angle is formed therebetween on the side facing upstream of the flow direction of the cooling medium.

Figure 7:
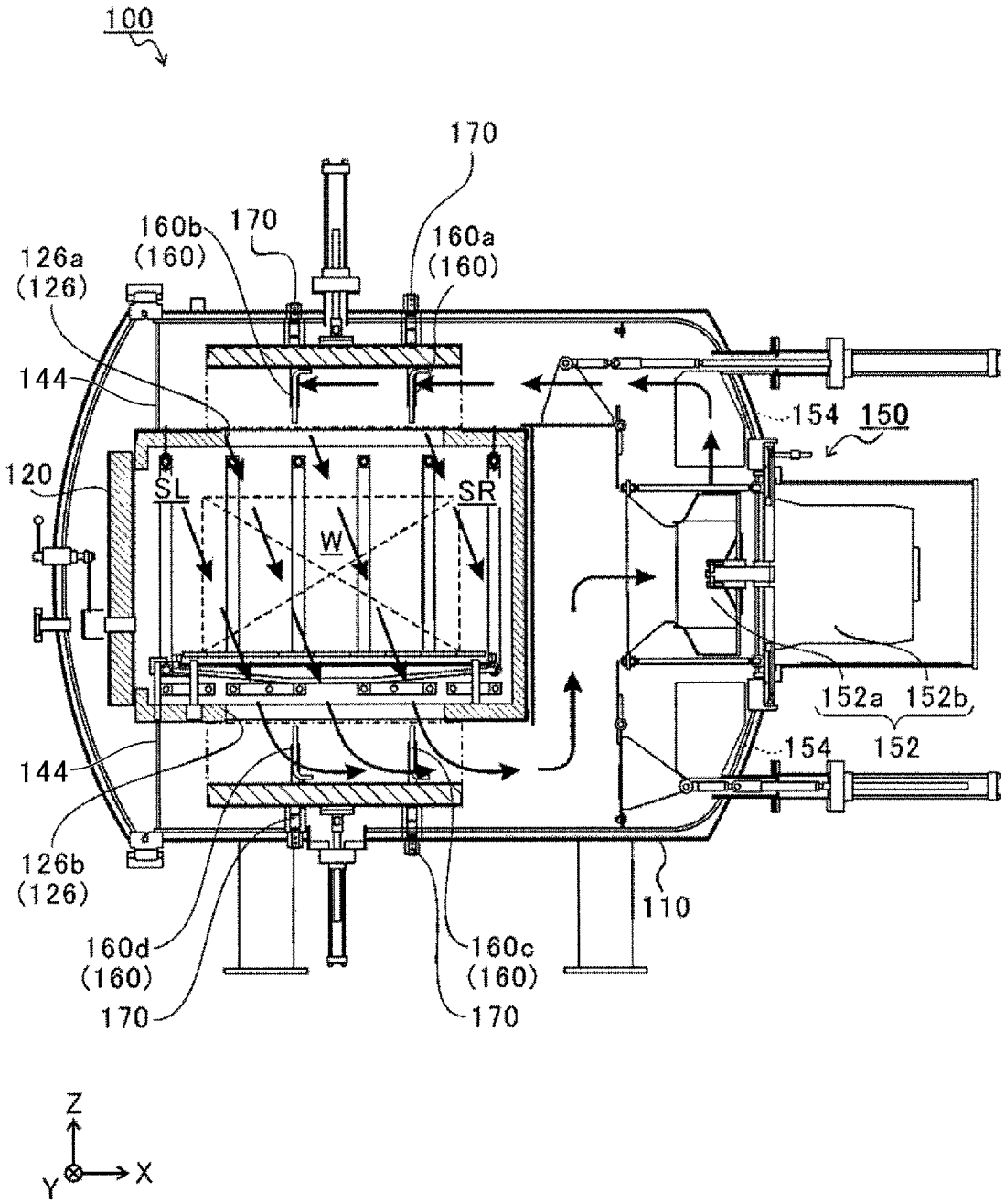
FIG. 7 is a lateral cross-sectional view showing the flow of a cooling medium in a first circulation direction.

FIG. 7 is a lateral cross-sectional view showing the flow of a cooling medium in the first circulation direction. The flow direction of the cooling medium is represented by arrows in FIG. 7. As shown in FIG. 7, the cooling medium supplied from the cooling unit 150 flows vertically upward, and thereafter, flows into a space between the top surface of the vacuum furnace 110 and the opening 126*a*.

Moreover, the cooling medium which has flowed into the space flows leftward from right in FIG. 7. Accordingly, in a case where a cooling medium is supplied into the heat-insulating container 120 without disposing the guide plates 160, the flow direction of the cooling medium is changed into a direction approaching the heat-insulating container 120 after the cooling medium strikes on the baffle plate 114 or the like, and thus, the flow rate of the cooling medium toward a space SR in the right side of FIG. 7 inside the heat-insulating container 120 may be less than the flow rate of the cooling medium toward a space SL in the left side of FIG. 7. Therefore, unevenness may occur in the flow rate of the cooling medium inside the heat-insulating container 120, and the treatment object W may not be uniformly cooled.

In this embodiment, during performance of the cooling process, the movement mechanisms 170 insert the guide plates 160*a* and 160*b* into the movement area 134 as an area adjacent to the opening 126*a*, and thus, the cooling medium can be efficiently supplied not only into the space SL but also into the space SR inside the heat-insulating container 120. In this way, it is possible to supply the cooling medium to reach every part of the inside of the heat-insulating container 120, and to uniformly cool the treatment object W.

The cooling medium guided into the heat-insulating container 120 is heated by cooling the treatment object W and is discharged from the heat-insulating container 120 through the opening 126*b*. Subsequently, after the cooling medium is suctioned by the fan 152*a*, the cooling medium is cooled (heat-exchanged) by the heat exchangers 154 and is supplied into the vacuum furnace 110 again.

When the cooling process to the treatment object W in this way is finished, the door 112 of the vacuum heat treatment device 100 and the side wall 128 of the heat-insulating container 120 are opened, and the treatment object W disposed inside the heat-insulating container 120 is unloaded to the outside thereof.

In addition, the movement mechanisms 170 retract the guide plates 160 from the movement areas 134. In this way, the arrangement for the next loading process is finished.

As described above, during performance of the cooling process using the guide plates 160, the movement mechanisms 170 insert the guide plates 160 into the movement areas 134 as areas adjacent to the openings 126. Therefore, the guide plates 160 are disposed to be adjacent to the openings 126 during the cooling process, the cooling medium can be supplied in order to reach every part inside the heat-insulating container 120, and thus, it is possible to uniformly cool the treatment object W.

In addition, the movement mechanisms 170 retract the guide plates 160 from the movement areas 134 before the movement of the cover portions 130. Therefore, it is possible to prevent the guide plates 160 from interfering with the movement of the cover portions 130, and to overlap the movement areas of the cover portions 130 with the disposition areas of the guide plates 160 during the cooling process. Consequently, it is possible to efficiently use the movement areas 134 which are not used except for the movement of the cover portions 130 in the related art, and to decrease the size of the vacuum heat treatment device 100.

Second Embodiment

Figure 8:
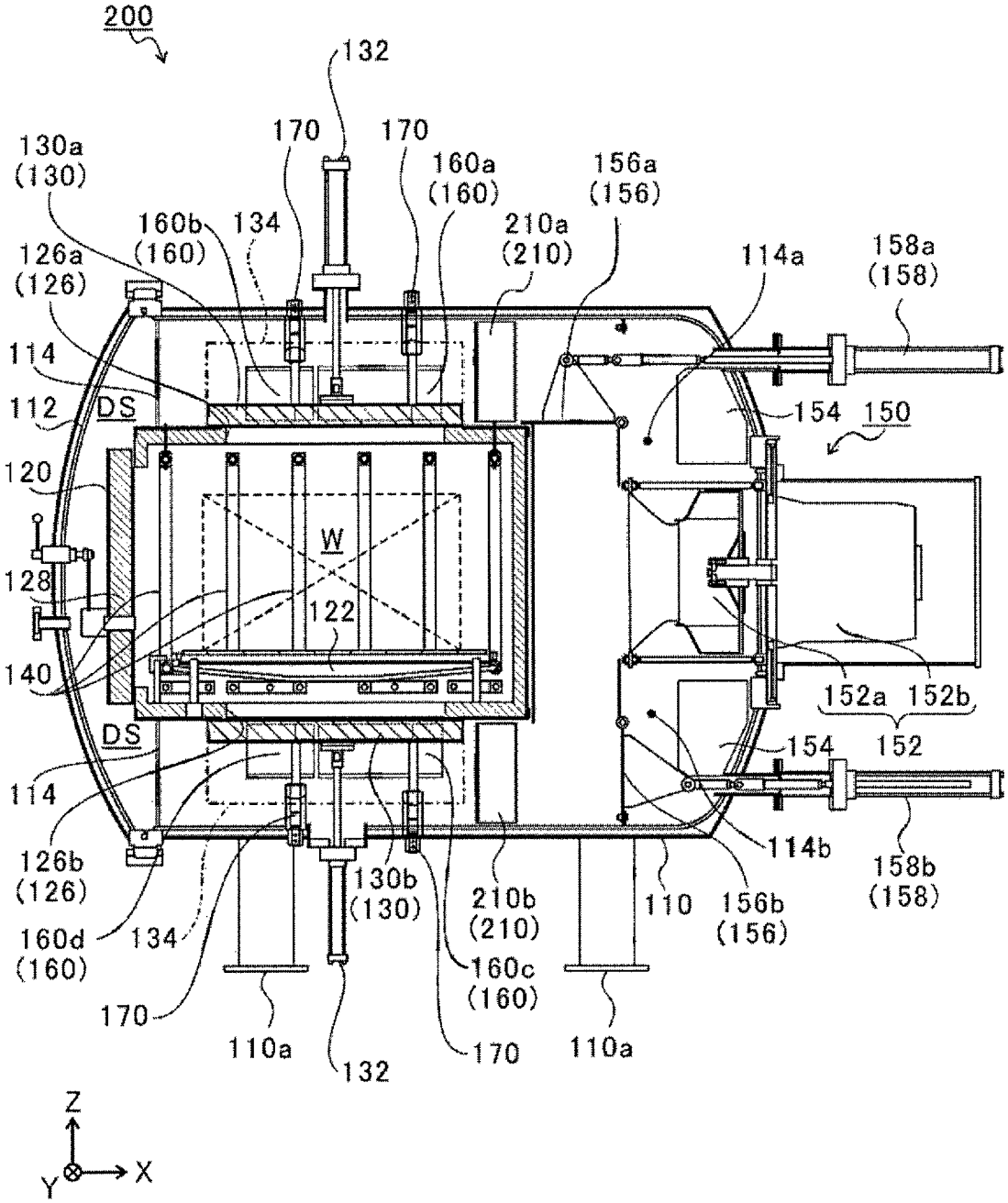
FIG. 8 is a lateral cross-sectional view showing a vacuum heat treatment device according to a second embodiment of the present invention.
Figure 9:
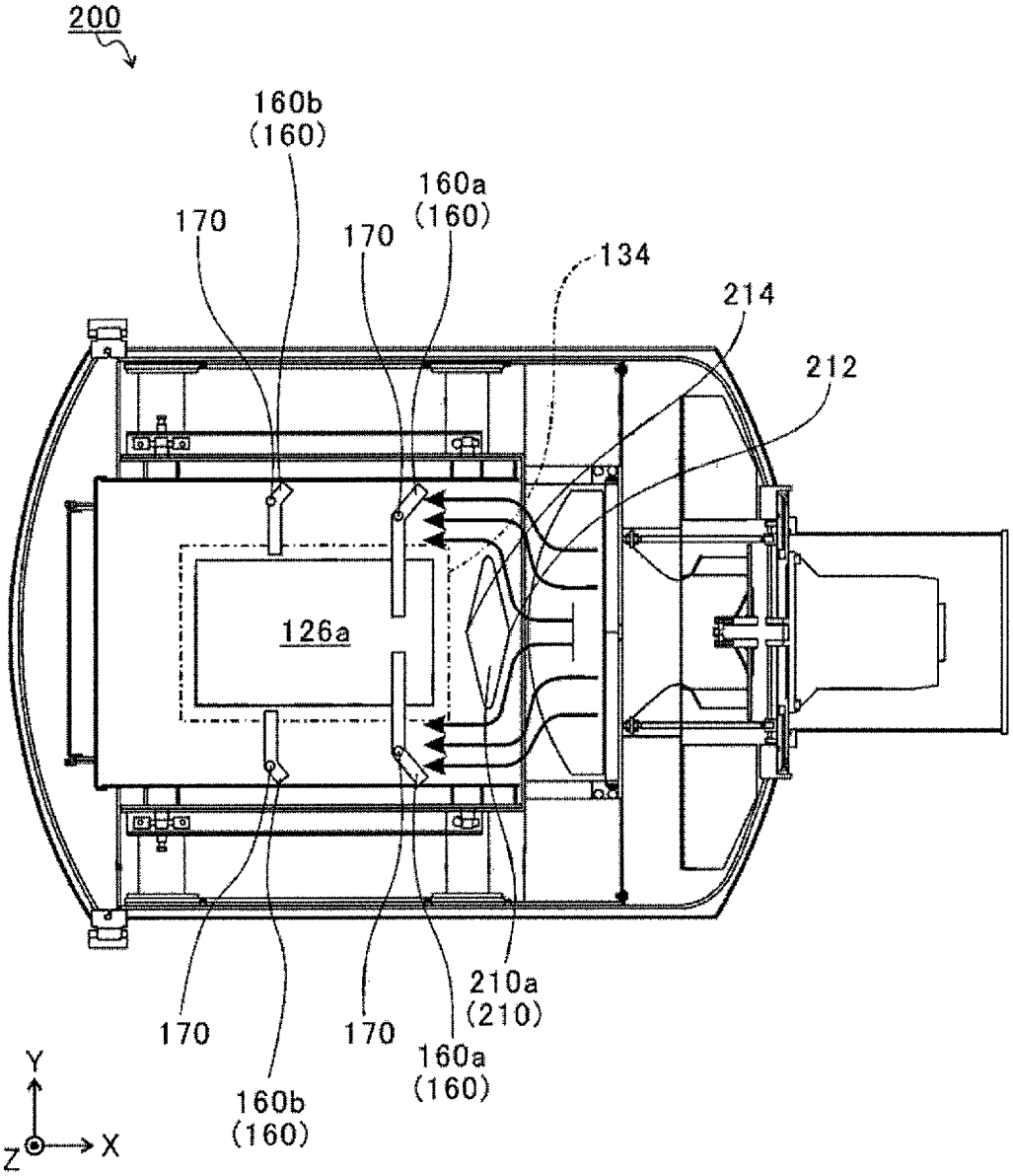
FIG. 9 is a plan cross-sectional view of the vacuum heat treatment device.

FIG. 8 is a lateral cross-sectional view showing a vacuum heat treatment device 200 according to a second embodiment. FIG. 9 is a plan cross-sectional view of the vacuum heat treatment device 200. Moreover, for convenience of description, the top surface of a vacuum furnace 110 and a cover portion 130*a* are omitted from FIG. 9.

As shown in FIG. 8, the vacuum heat treatment device 200 includes the vacuum furnace 110, a heat-insulating container 120, cover portions 130, a heating portion 140, a cooling unit 150, guide plates 160, movement mechanisms 170, and regulating plates 210. Moreover, the vacuum furnace 110, the heat-insulating container 120, the cover portions 130, the heating portion 140, the cooling unit 150, the guide plates 160, and the movement mechanisms 170 have substantially the same functions as in the above-described first embodiment. Therefore, these components are represented by the same reference signs as in the first embodiment and the descriptions thereof are omitted here, and the regulating plate 210 as a different component from the first embodiment is described in detail.

The regulating plates 210 (represented by reference signs 210*a* and 210*b* in FIG. 8) are provided further upstream than the openings 126 of the heat-insulating container 120 in the flow directions of the cooling medium supplied from the cooling unit 150. In this embodiment, a pair of regulating plates 210 is provided, a regulating plate 210*a* is disposed over the heat-insulating container 120, and a regulating plate 210*b* is disposed under the heat-insulating container 120. The regulating plate 210*a* is provided further upstream than the opening 126*a* of the heat-insulating container 120 in the first circulation direction, and the regulating plate 210*b* is provided further upstream than the opening 126*b* the heat-insulating container 120 in the second circulation direction. In addition, the regulating plates 210 are provided further upstream than the guide plates 160 in the flow directions of the cooling medium. That is, the regulating plate 210*a* is provided further upstream than the guide plates 160*a* in the first circulation direction, and the regulating plate 210*b* is provided further upstream than the guide plates 160*c* in the second circulation direction.

The regulating plates 210 have a function as a baffle plate used to block the cooling medium which directly flows toward the opening 126 in a direction parallel to the surface of the heat-insulating container 120 provided with the opening 126. Hereinafter, the regulating plate 210*a* in the first circulation direction is described in detail, and the description of the regulating plate 210*b* in the second circulation direction which has substantially the same configuration as that of the regulating plate 210*a* is omitted here.

As shown in FIG. 9, in this embodiment, the regulating plate 210*a* includes a projecting portion 212 provided in the central portion of the surface of the regulating plate 210*a* which faces upstream in the flow direction of the cooling medium (in the direction leftward from right in FIG. 9) supplied from the cooling unit 150. In addition, the regulating plate 210*a* is formed so that the cross-sectional area of the regulating plate 210*a* in a direction orthogonal to the flow direction of the cooling medium supplied from the cooling unit 150 (the cross-sectional area in a Y-Z plane in FIG. 9) gradually increases as it approaches downstream in the flow direction of the cooling medium from the projecting portion 212. In other words, the upstream surface in the above flow direction of the regulating plate 210*a* is formed as inclined surfaces which expand to both directions in the Y-axis direction as it approaches downstream from upstream in the above flow direction. In addition, the inclined surface is formed as a flat surface.

The cooling medium supplied from the cooling unit 150 flows vertically upward and flows into a space between the top surface of the vacuum furnace 110 and the opening 126*a*. Thereafter, as shown by arrows in FIG. 9, the cooling medium strikes on the regulating plate 210*a*, and by striking on the projecting portion 212, the cooling medium is dispersed toward both sides of the opening 126*a* (in both directions in the Y-axis direction). In this way, the regulating plate 210*a* is provided, and the cooling medium supplied from the cooling unit 150 is made to strike once on the regulating plate 210*a*, and thus, it is possible to decrease the flow speed of the cooling medium. Accordingly, it is possible to prevent the cooling medium from passing over the opening 126*a* and from flowing into the outside of the heat-insulating container 120.

Moreover, the cooling medium dispersed by striking on the regulating plate 210*a* mainly strikes on the second guide portions 164 (refer to FIG. 6) of a pair of guide plates 160.

In addition, the regulating plate 210*a* of this embodiment also includes a projecting portion 214 provided in the central portion of the surface of the regulating plate 210*a* which faces downstream in the flow direction of the cooling medium supplied from the cooling unit 150. The regulating plate 210*a* is formed so that the cross-sectional area thereof in a direction orthogonal to the above flow direction of the cooling medium (the cross-sectional area in a Y-Z plane in FIG. 9) gradually increases as it approaches upstream in the above flow direction of the cooling medium from the projecting portion 214. In other words, the downstream surface in the above flow direction of the regulating plate 210*a* is formed as inclined surfaces which expand in both directions in the Y-axis direction as it approaches upstream from downstream in the above flow direction. In addition, the inclined surface is formed as a flat surface.

That is, the horizontal cross-section of the regulating plate 210*a* is formed in a diamond shape.

By configuring the regulating plate 210*a* in this way, the inclined surfaces formed so that the projecting portion 212 is an apex can decrease the flow speed of the cooling medium when the cooling medium is supplied into the heat-insulating container 120. Moreover, when the cooling medium is discharged from the heat-insulating container 120 in the second circulation direction, the cooling medium strikes on the surface of the regulating plate 210*a* provided with the projecting portion 214, and thus, the inclined surfaces formed so that the projecting portion 214 is an apex can decrease the flow speed of the cooling medium.

Moreover, in this embodiment, a case where the inclined surface formed in the regulating plate 210*a* is a flat surface is described as an example. However, it is sufficient if the cross-sectional area of the regulating plate 210*a* in a direction orthogonal to the flow direction of the cooling medium gradually increases as it approaches downstream in the flow direction of the cooling medium from the projecting portion 212, and therefore, for example, the inclined surface may be curved.

Hereinbefore, the preferable embodiments of the present invention were described with reference to the drawings, but the present invention is not limited to the above embodiments. The shape, the combination or the like of each component shown in the above embodiments is an example, and additions, omissions, replacements, and other modifications of configurations can be adopted within the scope of and not departing from the gist of the present invention. The present invention is not limited to the above-described descriptions but is limited only by the scopes of the attached claims.

For example, in the above embodiments, a case where openings are provided on the top and bottom surfaces of the heat-insulating container 120 is described as an example, but openings may be provided on side surfaces opposite to each other of a heat-insulating container. In this case, a cooling medium is supplied into the heat-insulating container in the horizontal direction. In addition, in this case, the movement mechanisms 170 rotate the guide plates 160 around rotation axes extending in a direction in which the openings of the heat-insulating container are opposite to each other.

Moreover, openings do not have to be exactly opposite to each other, and it is sufficient if at least two openings are provided in a heat-insulating container. For example, openings may be provided on the top surface and one side surface of a heat-insulating container.

In addition, in the above embodiments, a case where the cover portion 130 moves in the direction orthogonal to the surface of the heat-insulating container 120 provided with the opening 126 is described as an example, but a cover portion may slide along the surface of a heat-insulating container provided with an opening or may rotate around a rotation axis provided on an edge of an opening.

Moreover, in the above embodiments, the pair of cover portions 130 (130*a* and 130*b*) are provided. However, at least two openings are provided in a heat-insulating container, and one cover portion may be configured to close both of the two openings.

Furthermore, in the above embodiments, the cooling unit 150 is configured to be capable of switching the circulation direction of a cooling medium to the first circulation direction or to the second circulation direction by moving the switching plates 156. However, a vacuum heat treatment device of the present invention may be configured to circulate a cooling medium only in one circulation direction.

In addition, since the vacuum heat treatment devices 100 and 200 of the above embodiments are capable of switching the circulation direction of a cooling medium to the first circulation direction or to the second circulation direction, the guide plates 160 are provided in positions corresponding to two openings 126*a* and 126*b*. However, in a case where a cooling unit circulates a cooling medium only in one circulation direction, it is sufficient if a guide plate 160 is provided only in a position corresponding to an opening (one of two openings) as an inlet of the heat-insulating container 120 through which the cooling medium flows. In addition, in a case where it is not necessary to decrease the flow speed of the cooling medium discharged from the heat-insulating container 120, it is sufficient if a regulating plate 210 is provided only upstream of an opening as an inlet.

INDUSTRIAL APPLICABILITY

The present invention can be applied to a vacuum heat treatment device which heats a treatment object in a vacuum state.

DESCRIPTION OF REFERENCE SINGS

W treatment object
100, 200 vacuum heat treatment device
110 vacuum furnace
120 heat-insulating container
126 opening
130 cover portion
134 movement area
140 heating portion
150 cooling unit
160 guide plate
162*a*, 162*b* first guide portion
164 second guide portion
170 movement mechanism
210 regulating plate
212, 214 projecting portion

The invention claimed is:

1. A vacuum heat treatment device comprising:

a vacuum furnace capable of decompressing an inside thereof to a vacuum state;

a heat-insulating container provided inside the vacuum furnace, the heat-insulating container being used to accommodate a treatment object and being provided with at least two openings;

a heating portion provided in the heat-insulating container, the heating portion being used to heat the treatment object;

a cover portion used to close at least the two openings of the heat-insulating container during heating to the treatment object by the heating portion;

a cooling unit used to cool and supply a cooling medium, the cooling unit being used to gather the supplied cooling medium;

a guide plate used to guide the cooling medium supplied by the cooling unit, into the heat-insulating container through one of the two openings of the heat-insulating container in a state where the two openings of the heat-insulating container are opened; and a movement mechanism used to move the guide plate so that at least part of the guide plate is inserted into a movement area of the cover portion in a state where the two openings of the heat-insulating container are opened and so that the guide plate is retracted from the movement area of the cover portion before the cover portion is moved in order to close the two openings of the heat-insulating container;

wherein the guide plate includes:

a first guide portion capable of being inserted into the movement area of the cover portion, the first guide portion allowing the cooling medium which flows in a direction parallel to a surface of the heat-insulating container provided with the one of the two openings to strike on the first guide portion so as to guide the cooling medium into the heat-insulating container; and a second guide portion used to guide the cooling medium to the first guide portion.

2. The vacuum heat treatment device according to claim 1, wherein the movement mechanism is configured to rotate the guide plate so as to insert the guide plate into the movement area or so as to retract the guide plate from the movement area.

3. The vacuum heat treatment device according to claim 1, further comprising:

a regulating plate provided further upstream than the one of the two openings in a flow direction of the cooling medium supplied from the cooling unit, the regulating plate being used to block the cooling medium directly flowing toward the one of the two openings in a direction parallel to a surface of the heat-insulating container provided with the one of the two openings.

4. The vacuum heat treatment device according to claim 2, further comprising:

a regulating plate provided further upstream than the one of the two openings in a flow direction of the cooling medium supplied from the cooling unit, the regulating plate being used to block the cooling medium directly flowing toward the one of the two openings in a direction parallel to a surface of the heat-insulating container provided with the one of the two openings.

5. The vacuum heat treatment device according to claim 3, wherein the regulating plate includes a projecting portion provided in a central portion of a surface of the regulating plate facing upstream in a flow direction of the cooling medium, and the regulating plate is formed so that a cross-sectional area of the regulating plate in a direction orthogonal to the flow direction of the cooling medium gradually increases as it approaches downstream in the flow direction of the cooling medium.

6. The vacuum heat treatment device according to claim 4, wherein the regulating plate includes a projecting portion provided in a central portion of a surface of the regulating plate facing upstream in a flow direction of the cooling medium, and the regulating plate is formed so that a cross-sectional area of the regulating plate in a direction orthogonal to the flow direction of the cooling medium gradually increases as it approaches downstream in the flow direction of the cooling medium.

7. A vacuum heat treatment device comprising:

a vacuum furnace capable of decompressing an inside thereof to a vacuum state;

a heat-insulating container provided inside the vacuum furnace, the heat-insulating container being used to accommodate a treatment object and being provided with at least two openings;

a heating portion provided in the heat-insulating container, the heating portion being used to heat the treatment object;

a cover portion used to close at least the two openings of the heat-insulating container during heating to the treatment object by the heating portion;

a cooling unit used to cool and supply a cooling medium, the cooling unit being used to gather the supplied cooling medium;

a guide plate used to guide the cooling medium supplied by the cooling unit, into the heat-insulating container through one of the two openings of the heat-insulating container in a state where the two openings of the heat-insulating container are opened;

a movement mechanism used to move the guide plate so that at least part of the guide plate is inserted into a movement area of the cover portion in a state where the two openings of the heat-insulating container are opened and so that the guide plate is retracted from the movement area of the cover portion before the cover portion is moved in order to close the two openings of the heat-insulating container; and a regulating plate provided further upstream than the one of the two openings in a flow direction of the cooling medium supplied from the cooling unit, the regulating plate being used to block the cooling medium directly flowing toward the one of the two openings in a direction parallel to a surface of the heat-insulating container provided with the one of the two openings;

wherein the regulating plate includes a projecting portion provided in a central portion of a surface of the regulating plate facing upstream in a flow direction of the cooling medium, and the regulating plate is formed so that a cross-sectional area of the regulating plate in a direction orthogonal to the flow direction of the cooling medium gradually increases as it approaches downstream in the flow direction of the cooling medium.

8. The vacuum heat treatment device according to claim 7, wherein the movement mechanism is configured to rotate the guide plate so as to insert the guide plate into the movement area or so as to retract the guide plate from the movement area.

* * * * *